US007552704B2

(12) United States Patent
Gaessler et al.

(10) Patent No.: US 7,552,704 B2
(45) Date of Patent: Jun. 30, 2009

(54) PROCEDURE TO OPERATE AN INTERNAL COMBUSTION ENGINE WITH AN ELECTROHYDRAULIC VALVE CONTROL

(75) Inventors: Hermann Gaessler, Vaihingen (DE); Karsten Mischker, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 165 days.

(21) Appl. No.: 11/545,950

(22) Filed: Oct. 10, 2006

(65) Prior Publication Data

US 2007/0079781 A1 Apr. 12, 2007

(30) Foreign Application Priority Data

Oct. 10, 2005 (DE) ..... 10 2005 048 346

(51) Int. Cl.
*F01L 9/02* (2006.01)

(52) U.S. Cl. ..... 123/90.12; 123/90.15

(58) Field of Classification Search ..... 123/90.12, 123/90.15

See application file for complete search history.

(56) References Cited

U.S. PATENT DOCUMENTS 5,255,641 A * 10/1993 Schechter ..... 123/90.11
5,890,078 A * 3/1999 Furuta ..... 701/1
2002/0069012 A1* 6/2002 Hartke et al. ..... 701/107
2005/0179623 A1* 8/2005 Negoi ..... 345/76

FOREIGN PATENT DOCUMENTS

EP 1047254 A1 * 10/2000

OTHER PUBLICATIONS

Abstract of EP1047254A1 shown above.*

* cited by examiner

*Primary Examiner*—Zelalem Eshete
(74) *Attorney, Agent, or Firm*—Merchant & Gould P.C.

(57) ABSTRACT

In a procedure to operate an internal combustion engine with an electrohydraulic valve control which comprises electrically activated oil control valves for hydraulic actuators for the actuation of charge-cycle valves, a motor control unit as well as an output stage unit, which is connected to the motor control unit via a data link, at least a limited operation of the internal combustion engine is made possible during a breakdown of the data bus between the motor control unit and the output stage unit, in that the output stage unit is transferred into an autonomous mode of operation during a breakdown of the data link to the motor control unit.

11 Claims, 4 Drawing Sheets

PROCEDURE TO OPERATE AN INTERNAL COMBUSTION ENGINE WITH AN ELECTROHYDRAULIC VALVE CONTROL

FIELD OF THE INVENTION

The invention at hand concerns a procedure to operate an internal combustion engine with an electrohydraulic valve control, which consists of electrically activated oil control valves for hydraulic actuators for the actuation of charge-cycle valves, a motor control unit as well as an output stage unit, which is connected to the motor control unit by way of a data link.

BACKGROUND

In an electrohydraulic valve control (EHVS) the oil control valves are electrically activated for the charge-cycle valves. Due to the incidental power loss in the output stages of the control unit, the output stages are deposed from the actual motor control unit, for example, disposed near the cylinder head and thereby in the spatial vicinity of the oil control valves. The end stages can thus be integrated into an output stage unit and comprise its own control functions as an "intelligent output stage unit". The intelligent output stage unit communicates via a data bus with the motor control unit. The separate assembly of the intelligent EHVS-output stage unit requires a real time capable communication interface, preferably in the form of a serial data bus (for example: CAN, TTCAN, Flexray, or another data bus system).

The breakdown of the data bus leads to a breakdown of the valve control, which leads to a shutdown of the motor and thus a stoppage of the vehicle. In this case, there is no longer a chance for a "limp home" function, i.e. no limited functionality for a trip home or to the repair shop.

The task of the invention at hand is therefore to allow at least a limited operation of the internal combustion engine when the data bus breaks down between the motor control unit and the output stage unit.

SUMMARY

The problem is solved through a procedure to operate an internal combustion engine with an electrohydraulic valve control, which consists of electrically activated oil control valves for hydraulic actuators for the actuation of charge-cycle valves, a motor control unit as well as an output stage unit, which is connected via a data link with the motor control unit, whereby the output stage unit is shifted into an autonomous operation mode when the data link breaks down. The output stage unit can consist of the end phases for all of the oil control valves or for only a part of the oil control valves. In this case several output stage units are connected with the motor control unit. For that purpose, all of the output stage units use the same data bus or communicate with the motor control unit via different data buses. Breakdown of the data link with the motor control unit means in this instance, that especially the serial data bus can no longer conduct a data transfer, for example, because a circuit is interrupted or an ulterior temporary or permanent disruption exists. This can also, for example, affect one of the controllers on the sides of the motor control unit, respectively the output stage unit. An autonomous operation mode means that the output stage unit is actuated by the motor control unit without data traffic. An advantage of the procedure according to the invention is a significant increase in the operational availability of the complete system (motor control unit with electrohydraulic valve control) in the case of an error, in which the communication medium, preferably then the serial data bus interface, has broken down between the two subsystems. An additional advantage is the avoidance of additional expenses for a double processing for the provision and the evaluation of two communication paths in the instance of a redundant implementation of the data bus. Additionally costs are avoided for the redundant implementation of the data bus interface between the motor control unit and "on site electronics", that is to say the output stage unit.

Provision is preferably made for parameters of the valve control, like the aperture angle in degrees of the crankshaft, the cam dwell in degrees of the crankshaft, the lift of the charge-cycle valves and the lift profile of the charge-cycle valves in the autonomous operation mode to be set at constant values. In so doing, the charge-cycle valves are activated as with a conventional mechanical cam shaft. The lift profile is thereby the lift of the charge-cycle valves beyond the crankshaft angle. The parameters of the valve control are preferably taken from a data storage, which can communicate with the output stage unit or is contained within the output stage unit. This can be a data storage integrated into the output stage unit or deposed from it, for example, in the form of a Read-only-Memories (ROM), of a Flash-storage or the like. The output stage unit receives a signal of a crankshaft angle indicator, so that the output stage unit can adjust the opening and closing of the charge-cycle valves as a function of the crankshaft angle. Provision can be made in an additional configuration for the parameters of the valve control to be a function of the engine rotational speed. Preferably provision is made for the parameters of the valve control to be deposited identically in the motor control unit. It is thereby possible for the motor control unit to calculate further parameters of the valve control, like the aperture angle, cam dwell angle, lift and lift profile and, for example, to influence the rail-pressure on the valve opening. In that way, the valve opening can be adjusted by the control unit to different operating conditions also when the data link breaks down. The output stage unit assumes thereby a constant rail-pressure in the pressure storage for the valve opening, so that a change in the parameters occurs when the rail-pressure changes.

Furthermore, provision can be made to attempt in suitable time intervals to start the construction of a data link when the data link to the control unit breaks down. The attempt to construct a data link can be initiated by both controllers, consequently by the controller for the serial data bus in the output stage unit and respectively by the controller for the serial data bus in the motor control unit.

Provision is made in an additional configuration for the lift profile of the charge-cycle valves to be affected by the motor control unit by way of the hydraulic system pressure. Certain parameters, for example, the oil temperature are not known by the output stage unit. These are, however, known by the motor control unit. The motor control unit can change the lift profile of the charge-cycle valves via the system hydraulic pressure (Rail pressure).

The problem mentioned at the beginning of the application is also solved by a procedure to operate an internal combustion engine with an electrohydraulic valve control, which comprises the electrically activated oil control valves for hydraulic actuators for the actuation of the charge-cycle valves, a motor control unit as a subsystem as well as an output stage unit as a subsystem, which is connected to a motor control unit by way of a data link. This procedure is thereby characterized, in that during a breakdown of a signal, which represents a crankshaft angle, the respective subsystem, which is different in each case, provides this signal via a data link. Thus, an increase in the operational availability of the complete system is achieved in the case of error in which the breakdown of the acquirement of the crankshaft position occurs (Crankshaft-Signal). While fuel injection as well as ignition and valve control go on synchronously at the current position of the crankshaft, this signal is necessary for an engine management system. The data bus is used according to the invention as an alternate path between the motor control unit and the output stage unit for the transfer of information.

The problem mentioned at the beginning of the application is also solved by a procedure to operate an internal combustion engine with an electrohydraulic valve control, which comprises electrically activated oil control valves for hydraulic actuators for the actuation of the charge-cycle valves, a motor control unit as a subsystem as well as an output phase unit as a subsystem, which is connected via a data link with the motor control unit. This procedure is thereby characterized, in that the output phase unit as well as the motor control unit transmit data packets at specified crankshaft times. In so doing, the operational availability of the data bus is guaranteed outside of the specified transmission times.

The problem mentioned at the beginning of the application is also solved by an internal combustion engine with an electrohydraulic valve control, which comprises electrically activated oil control valves for hydraulic actuators for the actuation of charge-cycle valves, a motor control unit as well as an output phase unit, which is connected via a data link with the motor control unit. This engine is thereby characterized, in that the output phase unit can be shifted into an autonomous mode of operation when the data link to the motor control unit breaks down. Preferably provision is made for the parameters of the valve control for the charge-cycle valves to be taken from the data storage, which is connected to the output phase unit. The parameters of the valve control are preferably identically deposited in the motor control unit.

The problem mentioned at the beginning of the application is also solved by an output phase unit for an electrically hydraulic valve control, which comprises electrically activated oil control valves for hydraulic actuators for the actuation of charge-cycle valves, whereby the output phase unit switches over to an autonomous mode of operation when a breakdown of the data link to the motor control unit occurs.

The output phase unit comprises preferably a (redundant) oscillator for clock pulse generation. The oscillator for clock pulse generation is preferably an RC-oscillator. For this reason the operational availability of the complete system: motor control with completely variable valve control will increase when a breakdown of the clock-pulse generator of the calculating unit in the motor control unit or in the output phase unit occurs.

BRIEF DESCRIPTION OF THE DRAWINGS

An example of embodiment of the invention at hand is subsequently more closely detailed using the accompanying drawing. Thereby the following are shown.

An example of embodiment of the invention is more closely detailed in the following description using the associated drawing. In so doing, the following are shown.

DETAILED DESCRIPTION OF THE DRAWINGS

Figure 1:
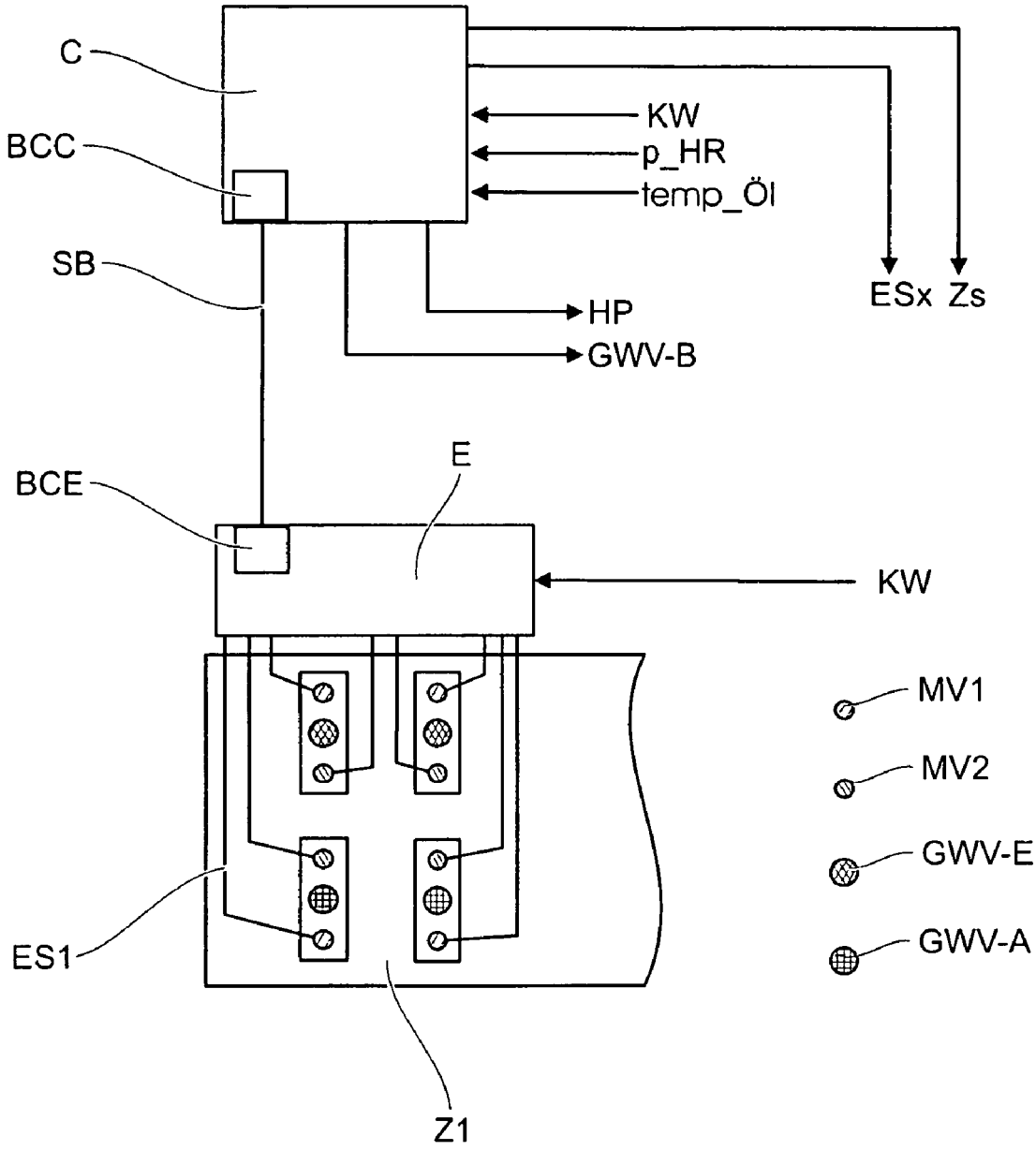
FIG. 1 a general configuration of the open loop control of an internal combustion engine with electrohydraulic valve control FIG. 2 a general configuration of an electrohydraulic valve control

FIG. 1 shows a configuration of an internal combustion engine with an engine management system. A cylinder Z1 is depicted with four charge-cycle valves, of which two charge-cycle valves are for the intake (GWV-E) as well as two charge-cycle valves for the exhaust (GWV-A). Also in this instance, only one intake valve and one exhaust valve or additional charge-cycle valves can be disposed at any one time. The internal combustion engine has several cylinders at its disposal, of which only one cylinder Z1 is depicted as an example. The charge-cycle valves GWV-E for the intake and the charge cycle valves GWV-A for the exhaust are respectively activated by two oil control valves MV1 and MV2 (see in addition FIG. 2). The oil control valves MV1 and MV2 are electrically activated by an output phase unit E. For this reason, the output phase unit E is at any one time connected with electrical signal lines to the oil control valves MV1 and MV2, of which only one (ES1) is depicted in FIG. 1 as an example. The output stage unit E is furthermore connected to the crankshaft angle indicator KW and obtains from it an electrical signal, which represents the crankshaft angle KW. The output phase unit E is connected to a motor control unit (Controller) by way of a serial data bus SB. For this reason, the output phase unit has a data bus controller BCE at its disposal and correspondingly the motor control unit C has a data bus controller BCC at its disposal. The engine management system C is furthermore electrically connected to a hydraulic pump HP, which provides the rail-pressure for the valve activation and delivers an electrical signal GWV-B to the control system of a brake operation for a decelerated seating of the charge-cycle valves into the valve seats. Finally the engine management system C delivers electrical injection signals $ES_x$ for unspecified injection valves of the internal combustion engine as well as for ignition signals ZS in a gasoline engine, whose spark plugs are likewise unspecified. Input signals for the engine management system are among other things the crankshaft angle KW, the pressure p_HR of the high pressure rail 9 as well as the temperature of the motor oil temp_Öl, or temp_Oil.

Figure 2:
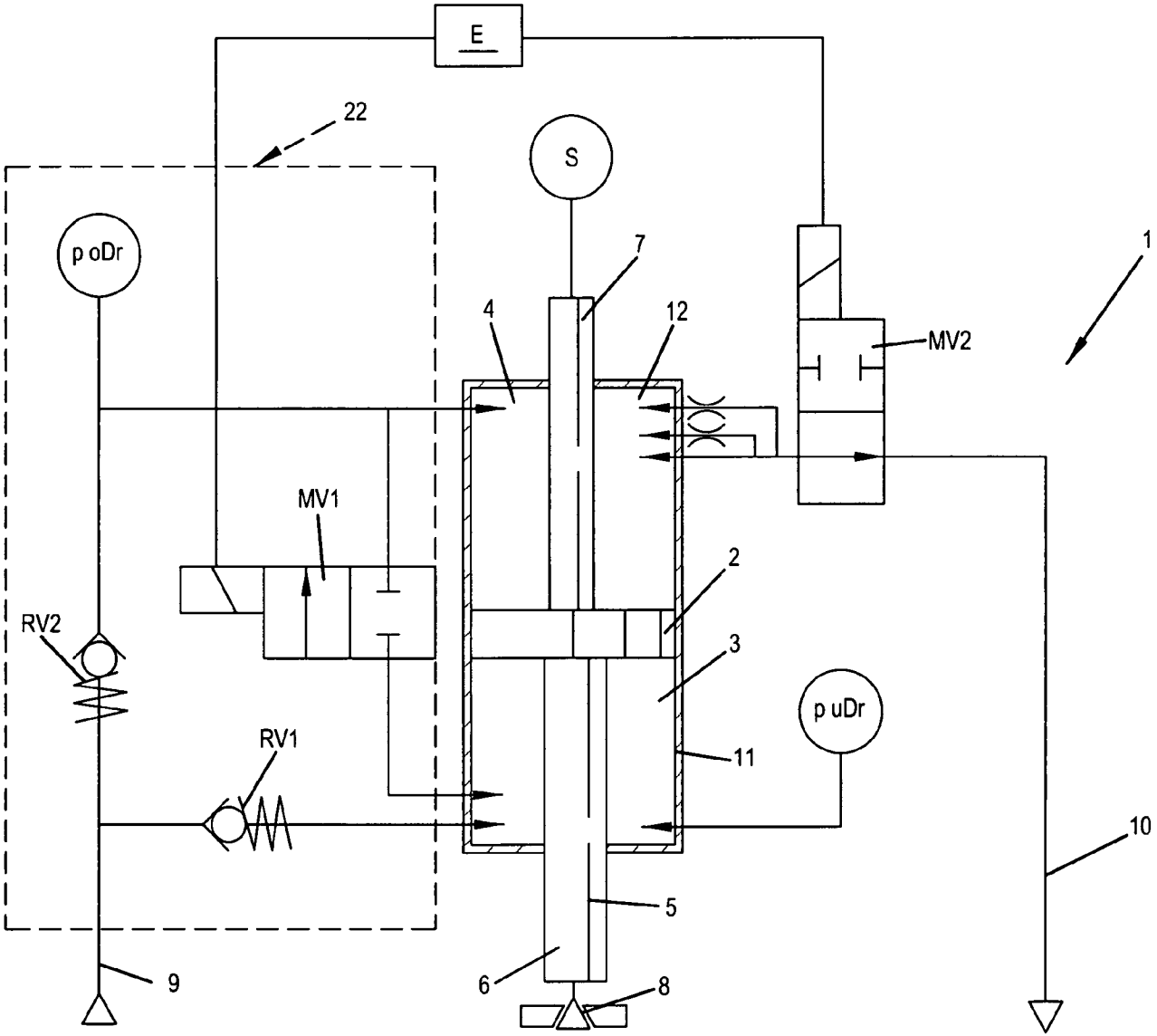

Using FIG. 2 the principle of a utilizable hydraulic valve control is depicted. It is understood, that other implementations of a hydraulic valve control or different variable valve controls can also be used. The valve control is a part of an internal combustion engine with lifting pistons, whereby the charge cycle results by way of inherently known charge-cycle valves (intake and exhaust valves). The opening and closing of the charge-cycle valves result by way of the hydraulic valve control depicted using FIG. 2 instead of by way of a camshaft and rocker arms or lifters to transfer the motion.

The hydraulic valve control 1 depicted in the form of a general configuration comprises essentially dual pistons 2, which work in conjunction with a lower pressure chamber 3 as well as an upper pressure chamber 4. The dual pistons are connected with a continuous lifter 5. The lifter 5 is in turn divided into a lower lifter 6 as well as an upper lifter 7. The lower lifter 6 is mechanically connected to an unspecified charge-cycle valve 8, which can be an intake or an exhaust valve. The hydraulic system for the charge-cycle valve depicted here is in principle identical to a hydraulic system of an intake valve. The lower pressure chamber 3 forms together with the dual pistons 2 and the lower lifter 6 a lower piston 11.

Correspondingly the upper pressure chamber 4 forms together with the dual pistons 2 and the upper lifter 7 an upper piston 12.

The dual pistons 2 form together with the lower pressure chamber 3 and the upper pressure chamber 4 a piston/cylinder arrangement, which acts in two directions and is correspondingly applicable. The hydraulic circuit as well as the mode of operation and at least approaches for integration into the engine management system of the piston motor are described as follows. A high pressure rail 9 is connected hydraulically via an initial check valve RV1 with the lower pressure chamber 3. The high pressure rail 9 is a hydraulic supply pipe connecting all of the valve controls of the internal combustion engine, which depending on the operating state of the motor, concerning especially engine rotational speed, load and the like, is maintained at a certain pressure level p_HR. The initial check valve has the effect of allowing a stream of hydraulic fluid only from the high pressure rail 9 into the lower pressure chamber 3. A back flow also at a higher pressure in the lower pressure chamber 3 as compared to that of the high pressure rail 9 is prevented in this way. The lower pressure chamber 3 is connected with the upper pressure chamber 4 by way of an initial magnetic valve MV1. The first magnetic valve MV1 possesses a closed and an open position. The depiction in FIG. 2 shows the open position. Instead of a magnetic valve other externally controlled valves can also be used here. In the open position of the initial magnetic valve MV1, a pressure equalization can occur between the lower pressure chamber 3 and the upper pressure chamber 4. The upper pressure chamber is additionally connected to the high pressure rail 9 via a second check valve RV2. Should the pressure in the upper pressure chamber 4 be greater than in the high pressure rail 9, a pressure equalization can also occur in this instance. The lines and valves of the hydraulic system, which can be pressurized during operation with the pressure of the high pressure rail are combined together conceptually as high pressure rail distributors. This is depicted in the configuration by a dashed line, which graphically separates the high pressure rail distributor 22 as a subsystem from the dual pistons 2 with their associated pressure chambers 3, 4 as well as from the return rail 10. The upper pressure chamber 4 is connected to a return rail 10 via a magnetic valve MV2. A pressure prevails in the return rail during operation which in the order of magnitude is of only a few bar. The return rail serves to deliver the hydraulic oil, which has flowed through the valve control 1, to a pump, which supplies the high pressure rail 9 with hydraulic oil of a higher pressure p_HR. The complete system is in this respect closed. In FIG. 2 only the part of the hydraulic valve control 1, which is here of interest, is depicted using one of the dual pistons 2 to actuate a charge-cycle valve. In an internal combustion engine one or several of the charge-cycle valves 8, which respectively are controlled by the same dual piston 2 or respectively by individually attached dual pistons 2, are present.

The magnetic valves MV1 and MV2 are activated electrically by a valve control unit. The valve control unit comprises a performance output stage as well as control logics and is either a part of an electronic control unit ECU or connected with this for exchange of data.

The valve control of the respective controllable valves is depicted in FIG. 2. These are the first magnetic valve MV1 and the second magnetic valve MV2 in the closed position of the charge-cycle valve 8. In this connection the first magnetic valve MV1 is closed and the second magnetic valve MV2 is open. This has the effect that the lower pressure chamber 3 is as before at the pressure level of the high pressure rail 9, the upper pressure chamber 4 is at the pressure level of the return rail 10. The pressure in the lower pressure chamber 3 is, therefore, higher than that in the upper pressure chamber 4. The dual pistons 2 are for this reason pressed in the direction of the upper pressure chamber 4. The charge-cycle valve 8 is thus closed.

The second magnetic valve MV2 is initially closed in order to open the charge-cycle valve 8, and then the first magnetic valve MV1 is opened. Hence, no longer can any hydraulic fluid flow from the upper pressure chamber 4 into the return rail 10. From now on, however, an exchange of hydraulic fluid between the lower pressure chamber 3 and the upper pressure chamber 4 is possible via the magnetic valve MV1. It should be understood from the configuration of FIG. 2 that the lower piston 11 has less of a hydraulically active surface area than the upper piston 12. The hydraulically active surface of the lower piston 11 is smaller than that of the upper piston 12. The surface area defined as the hydraulically active surface is that which during pressure impingement of the respective pressure chamber is impinged with pressure in the direction of movement of the piston. The different hydraulically active surfaces are indicated in the depiction of FIG. 2 by different diameters of the lower lifter 6 as compared to the upper lifter 7. The lower lifter has a larger diameter than the upper lifter and, therefore, the hydraulically active surface of the lower piston 11 is smaller than that of the upper piston 12.

The serial data bus is monitored by the data bus controller BCC of the motor control unit C as well as by the data bus controller BCE of the output stage unit E for a possible breakdown. A status signal ST of the data bus controller BCC and BCE indicates to both data bus components and consequently to the motor control unit C and the output stage unit E a breakdown of the data bus. By means of periodic checks, an absence of communication from the respective data bus controller BCC, respectively BCE, is recognized. If one of the two data bus controllers recognizes a breakdown of the serial data bus, the respectively assigned unit, that is to say the motor control unit C respectively the output stage unit E, is shifted into a "dry-running" mode of operation. In the mode of operation "dry-running", the output stage unit E expects no further information from the motor control unit C. From now on substitute activation signals for the oil control valves MV1 and MV2 of the respective charge-cycle valves GWV are taken from a data storage, for example a ROM, a Flash-Storage or something similar and if need be converted to a function of the engine rotational speed. Parameters, that are contained in these data sets, are, for example, beginning or the valve opening V_OE (aperture angle in degrees of crankshaft angle °KW), beginning of valve closing V_S (cam dwell angle in degrees of crankshaft angle °KW), valve lift VH as well as valve lift profile VHP beyond the crankshaft angle KW. An identical data set of these parameters is likewise deposited in the motor control unit C.

The data bus controllers BCC and BCE try respectively in suitable intervals to receive a communication from the opposite side. If this attempt succeeds in the case of a temporary disturbance, the motor control unit is shifted again back into the operational mode "normal operation". In the case of a long-term disturbance, the complete engine management system is operated further in the dry-running operation.

With the presence of a throttle valve, the throttling of the intake air mass can be managed with the help of the throttle valve. In the normal operation of an electrohydraulic valve control, the throttle valve, when present, is opened completely and the supply of air is controlled across the charge-cycle valves.

The adjustment of the hydraulic pressure of the system, consequently the pressure p_HR of the high pressure rail 9, which is provided by the hydraulic pump, results preferably directly across an output stage channel of the engine management system C and is thereby independent of the output stage unit E. For that reason it is possible to adjust the edge steepness dVH/dt and the lift VH of the charge-cycle valve movement independent of the output stage unit E. The engine management system C can thus impart an influence on the lift profile of the charge-cycle valves by communicating via the rail pressure p_HR and thereby conduct a charge cycle. In so doing, the charge cycle can in the emergency operation be adjusted to the load, engine rotational speed and the like at least within tight limits.

If in the electrohydraulic valve control a braking function is present for a defined delayed seating of the charge-cycle valves in the valve seats, the adjustment of the braking function thus results preferably directly over an output stage channel of the engine management system C, because the operating conditions, as its own pressure for the oil in the brake circuit and the oil temperature, which is necessary for the brake adjustment, can be simply acquired and processed.

The output stage unit E adjusts fixed emergency parameters for the electrohydraulic valve control, which are additionally deposited in the engine management system C. The engine management system C can establish in this instance the remaining operating parameters controlled by the engine management system, which have an influence on the actuator performance, to known standard values. Thus, for example, the hydraulic pressure of the system (Pressure p_HR in the high pressure rail 9) and the adjustment of the valve brakes are selectively fixed.

There are operating parameters, which in fact are more or less constant in the normal operation. They do, however, deviate rather significantly from the normal values at certain operating points. For example, the oil temperature is at approximately 80° C. in the normal operation. In the starting phase and the subsequent transient phase, it is dependent upon the ambient air temperature and deviates significantly from its temperature in the normal operation. This effect can be at least partially compensated for in the engine management system by a variation of the emergency parameters. While, for example, an emergency pressure of 100 bar is required at an oil temperature of 80° C., a higher pressure is set by the engine management system at lower temperatures, for example when starting the engine, in order to compensate for the effects of the deviating oil property. The emergency parameters of the output stage unit are constant. The oil temperature is not taken into account, because it is not known. The change in the oil pressure has the effect that the generally predetermined constant pressure of the output stage unit of, for example, 100 bar and an oil temperature of, for example, 80° C. leads to a correct lift profile of the respective charge-cycle valve. By means of the engine management system, the lift profile brought about by the output stage unit can additionally be changed by targeted change of the operating parameters, as, for example, the rail pressure in order, for example, to conduct a load control, for example, by a reduced lift of the charge-cycle valve caused by a drop in hydraulic pressure.

Furthermore, during the breakdown of one of the subsystems, the crankshaft signal redundantly present in the complete system can be put at the disposal of the respective other subsystem. The current crankshaft angle is permanently acquired from the engine management system 10 and the output stage unit E independently from each other. The crankshaft angle is permanently and ongoing available to both subsystems. During a breakdown of the crankshaft angle acquisition in the motor control unit C or in the output stage unit D, the crankshaft angle is then stringently synchronously transferred to the respective other subsystem. This can, for example, take place in such a manner, that all the information is transferred in a fixed, exactly defined angle raster. In so doing, the other subsystem has the possibility to draw a conclusion about the current crankshaft angle position based on the point in time of transfer and the transfer time. All of the messages can, for example, be transferred in a defined angle raster via the serial data bus. It is thereby possible to deposit at defined times data bus messages actually onto the data bus without having to worry that the data bus is occupied by other messages at desired crankshaft angles.

During a breakdown of the clock timing production for the engine management system C, respectively the output stage unit E, a limited operational availability of the complete system is guaranteed by a "substitute clock timing" with limited accuracy. During a breakdown of the normally quartz based clock timing generation in the output stage unit, it is possible to shift to a substitute signal. A possibility to make a substitute signal available with few means is achieved with the use of an RC-oscillator.

Figure 3:
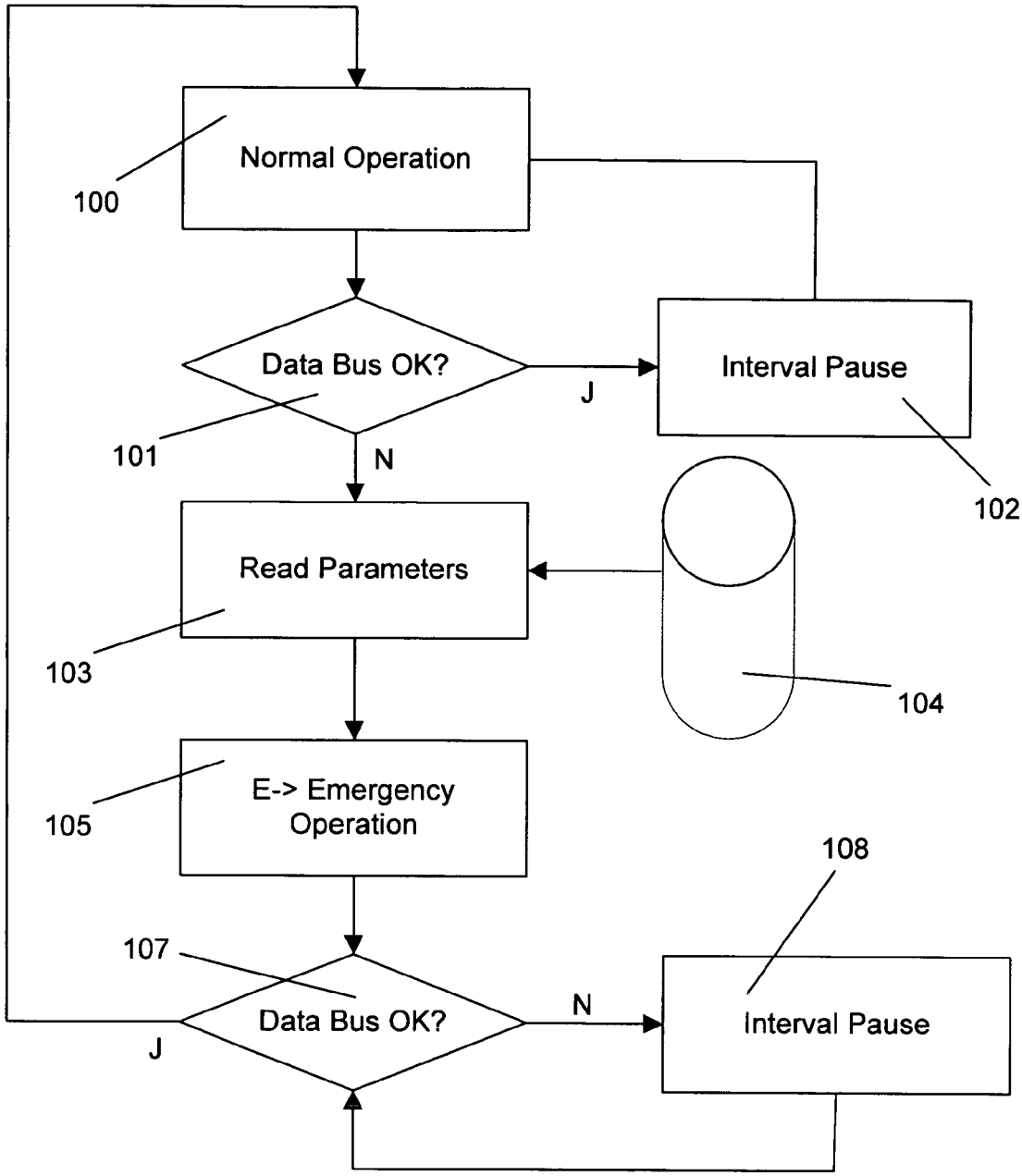
FIG. 3 illustrates the operating sequence of a procedure for shifting of an output stage unit.

FIG. 3 shows the operating sequence of the procedure for the shifting of the output stage unit into the autonomous operational mode using an operating sequence diagram. Starting with a step 100, the normal operation is initially adjusted and subsequently tested in step 101, if the data bus SB is in working order. If this is the case (option J), return is made by way of an interval pause 102 again to step 101 and thus the operation is branched into a long-term loop, in which the data bus SB is examined. Were the data bus not to be found to be OK, i.e. in working order (option N), the preset valve parameters in step 103 are then read from a data storage 104. Then in step 105, the operation is switched over to the emergency operation. The output stage unit E is, therefore, operated at the parameters read in step 103 with constant values for the charge-cycle valves GWV. In step 107, a check is thus made from time to time with a loop across an interval pause 108 to see if the data bus is again OK, i.e. in working order. If this is the case, the operation is branched back to step 100 and in so doing back to the normal operation. If this is not the case, the loop of steps 107 and 108 passes through on an ongoing basis.

Figure 4:
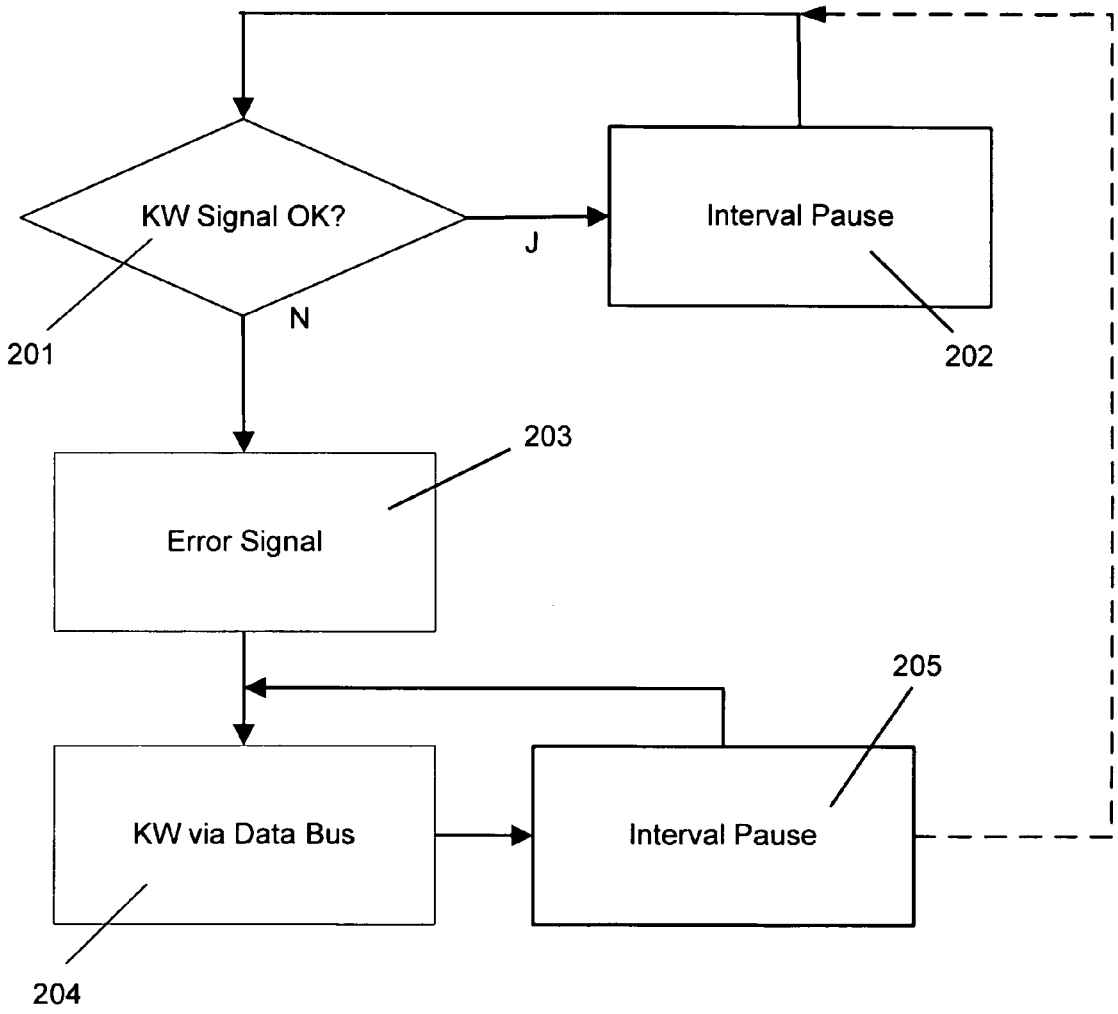
FIG. 4 illustrates the operating sequence of a procedure for the supply of the crankshaft indicator signal.

FIG. 4 shows the operating sequence of the procedure for the supply of the crankshaft indicator signal using an operating sequence diagram. The procedure is depicted exemplary for the breakdown of the crankshaft indicator signal at the motor control unit. It proceeds basically in the same way for a breakdown of the crankshaft indicator signal at the output stage unit E. In step 201, a test is made if the crankshaft indicator signal is lying at the motor control unit C. If this is the case (option J), the operation is branched into an infinite loop across the interval pause 202 to the beginning. If the crankshaft indicator signal is not present, a data packet, which signals this error, is sent to the output stage unit E in step 203. At this point in step 204, the output stage unit delivers the crankshaft angle KW in appropriate time intervals. This is depicted by an interval pause 205 and a loop back to step 204 via the serial data bus SB to the motor control unit C. The motor control unit checks parallel to the above action in appropriate intervals, if the crankshaft indicator signal is once again lying at the motor control unit. This is depicted by means of a dashed line between the steps 205 and 201.

The invention claimed is:

1. A method of operating an internal combustion engine with an electrohydraulic valve control having electrically activated oil control valves for hydraulic actuators that actuate charge-cycle valves, a motor control unit, and an output stage unit, which via a data link is connected to the motor control unit, the method comprising:

shifting the output stage unit into an autonomous mode of operation during a breakdown of the data link to the motor control unit; and setting parameters of the electrohydraulic valve control to constant values in the autonomous mode of operation.

2. A method according to claim 1, wherein setting parameters includes taking the parameters of the valve control from a data storage, which can communicate with the output stage unit or is contained in the output stage unit.

3. A method according to claim 1, wherein parameters of the electrohydraulic valve control are a function of the engine rotational speed.

4. A method according to claim 1, further comprising attempting to construct the data link during a breakdown of the data link to the motor control unit.

5. A method according to claim 1, further comprising influencing a lift profile of the charge-cycle valves is influenced by the motor control unit by way of hydraulic pressure of the system.

6. A method of operating an internal combustion engine with an electrohydraulic valve control having electrically activated oil control valves for hydraulic actuators that actuate charge-cycle valves, a motor control unit, and an output stage unit, which via a data link is connected to the motor control unit, the method comprising:

shifting the output stage unit into an autonomous mode of operation during a breakdown of the data link to the motor control unit; and wherein parameters of the electrohydraulic valve control are identically deposited in the motor control unit.

7. An internal combustion engine with an electrohydraulic valve control, which comprises electrically activated oil control valves for hydraulic actuators that actuate charge-cycle valves, a motor control unit, and an output stage unit, which is connected to the motor control unit via a data link, wherein the output stage unit during a breakdown of the data link to the motor control unit can be shifted to an autonomous mode of operation, wherein parameters of the electrohydraulic valve control for the charge-cycle valves are taken from a data storage, which is connected to the output stage unit.

8. An internal combustion engine with an electrohydraulic valve control, which comprises electrically activated oil control valves for hydraulic actuators that actuate charge-cycle valves, a motor control unit, and an output stage unit, which is connected to the motor control unit via a data link, wherein the output stage unit during a breakdown of the data link to the motor control unit can be shifted to an autonomous mode of operation, wherein parameters of the electrohydraulic valve control are identically deposited in the motor control unit.

9. An output stage unit for an electrohydraulic valve control, which comprises electrically activated oil control valves for hydraulic actuators that actuate charge-cycle valves, wherein the output stage unit switches to an autonomous mode of operation during a breakdown of a data link to a motor control unit, wherein parameters of the electrohydraulic valve control are identically deposited in the motor control unit.

10. An output stage unit according to claim 9, wherein the output stage unit comprises an oscillator for clock timing generation.

11. An output stage unit according to claim 10, wherein the oscillator for clock timing generation is an RC-oscillator.

* * * * *